United States Patent [19]

Harris

[11] Patent Number: 4,789,162

[45] Date of Patent: Dec. 6, 1988

[54] WORD AND MESSAGE FORMING BOARD GAME

[76] Inventor: Amos L. Harris, 2532 Ohio St., Paducah, Ky. 42001

[21] Appl. No.: 54,725

[22] Filed: May 27, 1987

[51] Int. Cl.[4] ..... A63F 3/00

[52] U.S. Cl. ..... 273/272; 273/153 R

[58] Field of Search ..... 273/153 R, 272, 156

[56] References Cited

U.S. PATENT DOCUMENTS 4,185,830 1/1980 James ..... 273/153 R 4,215,864 8/1980 Nichols ..... 273/153 R

FOREIGN PATENT DOCUMENTS 373348 5/1932 United Kingdom ..... 273/153 R

OTHER PUBLICATIONS

Quote-Acrostic, The Washington Post Magazine, May 20, 1979, p. 42.

Pocket Crossword Puzzles, May 1979 issue, p. 56.

*Primary Examiner*—Anton O. Oechsle

*Attorney, Agent, or Firm*—Leon Gilden

[57] ABSTRACT

A word completion game utilizes a game board with spaces for filling in missing letters. Through the use of word clues, the missing letters are utilized to complete messages in two directions.

1 Claim, 3 Drawing Sheets

FIG 2
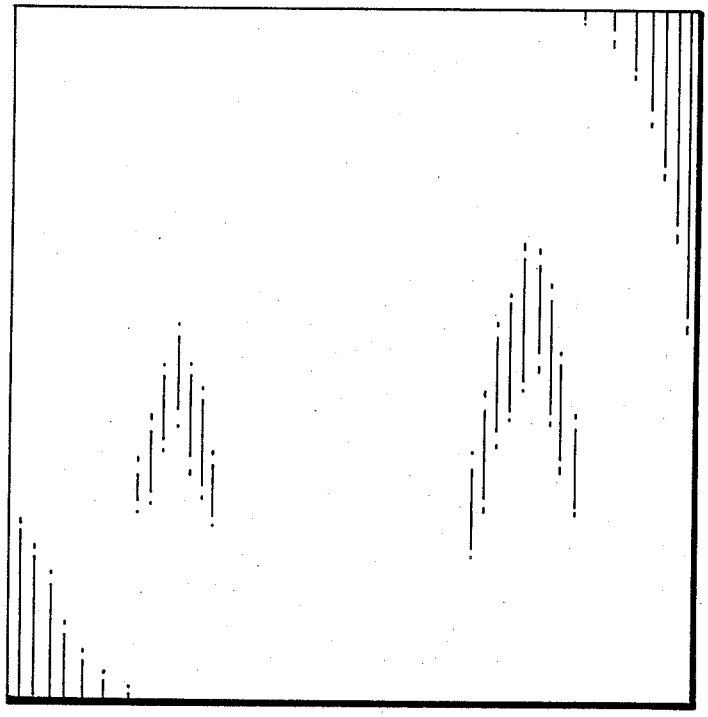
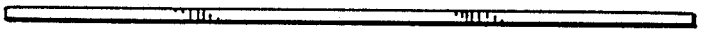
FIG 3

WORD AND MESSAGE FORMING BOARD GAME

BACKGROUND OF THE INVENTION

1. Field of the Invention

The present invention relates to games, and more particularly pertains to a word and message completion game utilizing a game board.

2. Description of the Prior Art

The prior art is replete with various types of word games which, for the most part, utilize entire words or words which are built by chance, such as by throwing dice or the like. As can be appreciated, there is a continuing need for new and interesting games which employ word and message completion processes, and in this respect, the present invention substantially fulfills this need.

SUMMARY OF THE INVENTION

The present invention provides for an improved word and message completion game wherein a game board is utilized for completing a plurality of words which then provide messages in two different directions. As such, the general purpose of the present invention, which will be described subsequently in greater detail, is to provide a new and improved word completion game which has all the advantages of the prior art word completion games and none of the disadvantages.

To attain this, the present invention comprises a game board having a plurality of vertically aligned columns in which words can be formed. Each of the columns are provided with a number of spaces representing the number of letters in an undisclosed word, and each such column is also provided with one of the letters associated with the missing word. In this respect, the letter is positioned in its proper place within the missing word, and a plurality of clues are then provided to help a player determine which word goes in each column. When all of the proper words are inserted within the columns, the words may be read in a preselected order to provide a completed message to the player. Additionally, the first letters of each of the words are aligned to provide a second message to the player. The letters of the words may be either written into the provided spaces or alternatively, removable squares having letters imprinted thereon may be positioned on the board during the game playing process. Different scores can be provided for different letters, so that a multitude of players can achieve individual scores to determine a winner during a playing of the game to completion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved word completion game which has all the advantages of the prior art word completion games and one of the disadvantages.

It is another object of the present invention to provide a new and improved word completion game which may be easily and efficiently manufactured and marketed.

It is a further object of the present invention to provide a new and improved word completion game which is of a durable and reliable construction.

An even further object of the present invention is to provide a new and improved word completion game which is susceptible of a low cost of manufacture with regard to both materials and labor, and which accordingly is then susceptible of low prices of sale to the consuming public, thereby making such word completion games economically available to the buying public.

Still yet another object of the present invention is to provide a new and improved word completion game which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a bottom plan view of the game board.

FIG. 3 is a left side elevation view of the game board.

DESCRIPTION OF THE PREFERRED EMBODIMENT

Figures 1, 4:
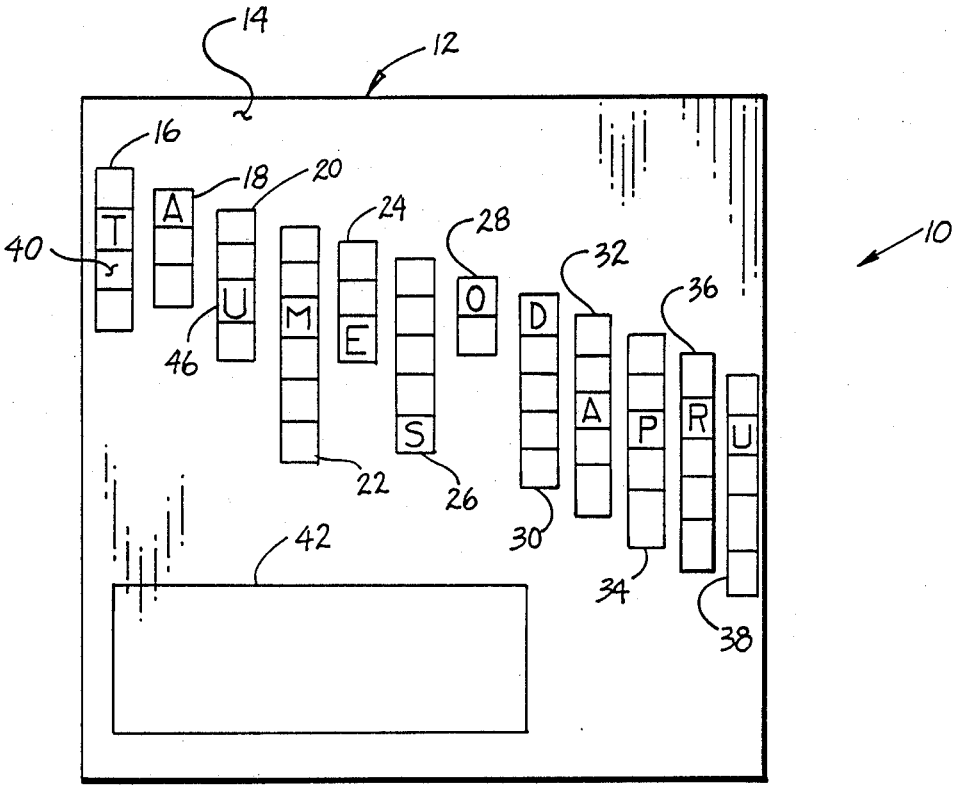
FIG. 1 is a top plan view of the game board forming a part of the present invention.
FIG. 4 is a right side elevation view of the game board.
Figure 5:
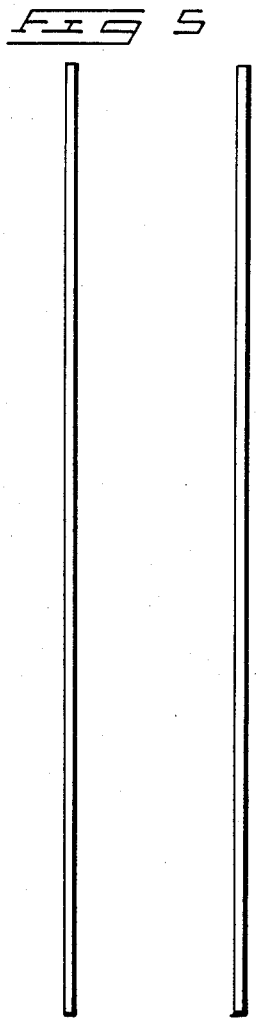
FIG. 5 is a front elevation view of the game board.
Figure 6:
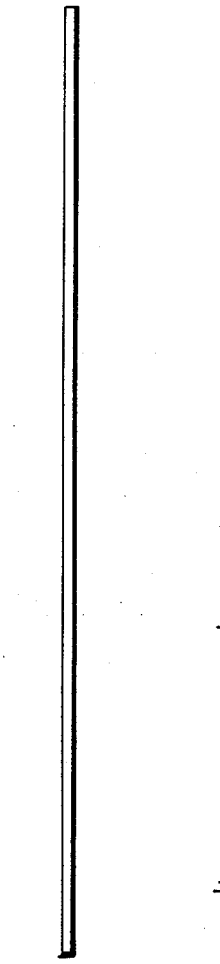
FIG. 6 is a rear elevation view of the game board.
Figure 7:
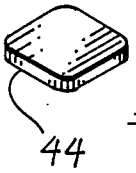
FIG. 7 is a perspective view of a playing piece forming a part of the game board assembly comprising the present invention.
Figure 8:
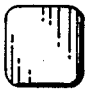
FIG. 8 is a bottom plan view of the game piece.

With reference now to the drawings, and in particular to FIGS. 1–13 thereof, a new and improved word completion game embodying the principles and concepts of the present invention and generally designated by the reference numeral 10 will be described.

More specifically, it will be noted that the game 10 includes a game board 12 having a top playing surface 14. The playing surface 14 includes a plurality of vertically aligned columns 16–38. Each of the columns 16–38 include a plurality of blocks or squares 40. In this respect, such blocks or squares 40 are generally illustrated by the same reference numeral throughout all of the columns 16–38. As will be further realized by reviewing FIG. 1 of the drawings, each column 16–38 includes a specific number of the blocks 40 so as to define the length of a particular word which can be inserted in a selected column.

Figure 9:
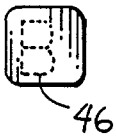
FIG. 9 is a top plan view of the game piece.
Figure 10:
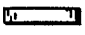
FIG. 10 is a left end elevation view of the game piece.
Figure 11:
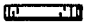
FIG. 11 is a right end elevation view of the game piece.
Figure 12:
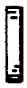
FIG. 12 is a front elevation view of a game piece.
Figure 13:
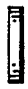
FIG. 13 ia a rear elevation view of a game piece.

Additionally, each game playing surface 14 includes an embossed area 42 in which a plurality of word clues can be inscribed. As illustrated in FIGS. 7–13, game playing pieces 44 are sized to be removably positioned over a particular block 40, and as best illustrated in FIG. 9, each game playing piece may be provided with a letter 46 to facilitate the completion of a properly spelled word within a particular column 16–38.

As to the manner of playing the above-described game 10, it will be observed that each of the columns 16–38 is provided with one prepositioned letter 46 to assist a player in the playing of a game. While many solutions could be provided for the game 10, a particular solution will be described to facilitate an understanding of the method of playing the game. In this regard, with one letter 46 inserted in each of the columns 16–38, a player will attempt to complete words in all of the columns so that the words can be read to provide a particular understandable message. Additionally, a proper solution to the game will include all of the topmost positioned blocks 40 in each of the columns 16–38 spelling out a second different message.

As such, the following clue words could be provided in the clue box 42: TEACH, REACH, OWE, ONE, TRADE, GRADE, SUCCESS, PROCESS, ON, OF, SUPER, UPPER, TEENS, BEANS, LUMBER, NUMBERS, FOUR, YOUR, AID, ALL, STOP, SLOP, DRUGS, DOORS, TOPS, HOPS, PLUGS. With a multitude of players, individual points could be awarded for each proper letter selected, and various point scores could be assigned to all of the letters of the alphabet. Additionally, a total of ten points for each proper colunn solution could be provided so as to allow for an additional 120 points to be accumulated by individual players. With the proper words inserted in columns 16–38, the message would be "STOP ALL YOUR NUMBER ONE TEENS ON DRUGS. REACH UPPER GRADE SUCCESS." By the same token, with these words inserted in the columns 16–38, the first letter of each word would then provide the further message "SAY NO TO DRUGS".

As can be appreciated, variations to the game could include increasing the length of columns 16–38, and the prepositioning of letters 46 in each of the columns as indicated by a provided game book. Additionally, the game book could indicate the length of each of the columns 16–38 for a particular game, so that a large number of solutions would be available for each game assembly.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A word and message completion game comprising:

(a) a game surface; and (b) a letter layout on said game surface including a message means comprising a plurality of aligned vertical columns for receiving letters in prescribed blocks thereon, said columns providing a first message to a player when proper letters are positioned within each of said prescribed blocks in said aligned columns, said proper letters defining a word in each column which taken together provide said first message, and further wherein first letters in each of said words are aligned to provide a further message to said player, and further including game playing pieces, said playing pieces each having a letter on at least one face thereof, said pieces being of equal surface dimension to said prescribed blocks and positionable within said prescribed blocks to complete said words, and a rectangular clue means positioned on said game board in underlying relationship to said columns combining a rectangular block for inclusion therein of a series of clue words including random words and said words which provide said messages to assist said player in resolving said word and message game.

* * * * *